US011063331B1

(12) United States Patent
Wang

(10) Patent No.: US 11,063,331 B1
(45) Date of Patent: Jul. 13, 2021

(54) STRUCTURED HYBRID DIFFERENT-WAVELENGTH RESONANT CERAMIC FILTER

(71) Applicant: XIAMEN SUNYEAR ELECTRONICS CO., LTD., Xiamen (CN)

(72) Inventor: Junyuan Wang, Xiamen (CN)

(73) Assignee: XIAMEN SUNYEAR ELECTRONICS CO., LTD., Xiamen (CN)

( * ) Notice: Subject to any disclaimer, the term of this patent is extended or adjusted under 35 U.S.C. 154(b) by 0 days.

(21) Appl. No.: 16/848,720

(22) Filed: Apr. 14, 2020

(30) Foreign Application Priority Data

Mar. 6, 2020 (CN) ..... 202010153329.7

(51) Int. Cl.
*H01P 1/205* (2006.01)
*H01P 1/202* (2006.01)
*H01P 1/208* (2006.01)

(52) U.S. Cl.
CPC ..... *H01P 1/2086* (2013.01)

(58) Field of Classification Search
CPC ..... H01P 1/202; H01P 1/205; H01P 1/2053; H01P 1/2056
USPC ..... 33/202, 206
See application file for complete search history.

(56) References Cited

U.S. PATENT DOCUMENTS 4,879,533 A * 11/1989 de Muro ..... H01P 1/2136 333/206
4,985,690 A 1/1991 Eguchi et al.
5,745,018 A * 4/1998 Vangala ..... H01P 1/2056 333/202
5,808,526 A * 9/1998 Kaegebein ..... H01P 1/205 333/202
5,994,978 A 11/1999 Vangala
6,204,738 B1 3/2001 Toda et al.
6,281,768 B1 * 8/2001 Tada ..... H01P 1/2056 333/134
6,400,239 B1 * 6/2002 Chun ..... H01P 1/2056 333/202
6,549,101 B2 4/2003 Gotoh et al.
6,724,279 B1 * 4/2004 Kitajima ..... H01P 1/2056 333/134

(Continued)

FOREIGN PATENT DOCUMENTS

CN 201420531643 2/2015
CN 201621126799 7/2017
CN 201710916183 2/2018

*Primary Examiner* — Dean O Takaoka

(57) ABSTRACT

Disclosed is a structured hybrid different-wavelength resonant ceramic filter, comprising a ceramic substrate and an input/output electrode, wherein the ceramic substrate comprises a first surface and a second surface opposite to the first surface, five first resonant cavities, two second resonant cavities and two third resonant cavities are formed between the first surface and the second surface in a horizontal direction; the five first resonant cavities are located in the middle of the first surface of the ceramic substrate, the two second resonant cavities are respectively located at both sides of the five first resonant cavities, and the two third resonant cavities are respectively located lateral relative to the two second resonant cavities. With the present disclosure, filters with various forms and functions are integrated into a multi-cavities filter, and it is simple in structure.

9 Claims, 12 Drawing Sheets

(56) References Cited

U.S. PATENT DOCUMENTS

| | | | | |
|---|---|---|---|---|
| 6,914,499 | B2 * | 7/2005 | Kitaichi | H01P 1/2056 333/134 |
| 10,541,457 | B2 * | 1/2020 | Wang | H01P 3/12 |
| 2018/0175471 | A1 * | 6/2018 | Chou | H01P 7/065 |

* cited by examiner

STRUCTURED HYBRID DIFFERENT-WAVELENGTH RESONANT CERAMIC FILTER

CROSS-REFERENCE TO RELATED APPLICATIONS

The present application claims the benefit under 35 U.S.C. § 119 of China Patent Application No. 202010153329.7, filed on Mar. 6, 2020 in the China National Intellectual Property Administration, the content of which is hereby incorporated by reference.

TECHNICAL FIELD

The present disclosure relates to the field of filters, in particular to a structured hybrid different-wavelength resonant ceramic filter.

BACKGROUND

Ceramic filters are divided into band-stop filters (also known as notch filters) and band-pass filters (also known as filters) according to their amplitude-frequency characteristics. They are mainly used in frequency-selection networks, IF tuning, frequency discrimination, and filter circuits to achieve the purpose of separating currents of different frequencies, and are featured with high Q value, good amplitude frequency and phase frequency characteristics, small size, and high signal-to-noise ratio. However, a band-pass filter only allows signals in a specified frequency band to pass through, and suppresses signals at other frequencies; while a band-stop filter suppresses signals in a specific frequency band and allows other signals to pass through. Therefore, the existing ceramic filters are single in function and not capable of frequency band usage under the full frequency demand.

SUMMARY

The present disclosure provides a structured hybrid different-wavelength resonant ceramic filter, which can integrate filters with various forms and functions into an integrated multi-cavity filter, and realizes excellent suppression function at low and high frequencies beyond the passband.

The present disclosure adopts the following technical measures:

A structured hybrid different-wavelength resonant ceramic filter comprises a ceramic substrate and an input/output electrode. The ceramic substrate comprises a first surface and a second surface opposite to the first surface. The five first resonant cavities, two second resonant cavities and two third resonant cavities are formed between the first surface and the second surface in a horizontal direction. The five first resonant cavities are located in the middle of the first surface of the ceramic substrate. The two second resonant cavities are respectively located at both sides of the five first resonant cavities. The two third resonant cavities are respectively located lateral relative to the two second resonant cavities.

An inner wall of each of the resonant cavities is coated with metal, and five of the first resonant cavities and two of the third resonant cavities are coated with metal at one end located on the second surface. The input/output electrode is disposed at the first surface, and are electrically connected to two of the second resonant cavities. Five of the first resonant cavities are coupled to form a fifth-order band-pass filter.

Each of the second resonant cavities is coupled to an adjacent one of the third resonant cavities to form a band-stop filter.

In some embodiments, the first resonant cavities and the third resonant cavities are half-wavelength resonant cavities, and the second resonant cavities are quarter-wavelength resonant cavities.

In some embodiments, five of the first resonant cavities and two of the second resonant cavities are arranged at a same height on the ceramic substrate and are located approximately at a center of the first surface of the ceramic substrate. Two of the third resonant cavities are arranged at a same height on the ceramic substrate, and the height of the third resonant cavities is slightly lower than the height of the first resonant cavities and the second resonant cavities.

In some embodiments, the ceramic substrate has a rectangular structure.

In some embodiments, the third resonant cavities comprise a first segmental bore and a second segmental bore that are coaxial to each other. The second segmental bore is adjacent to the first surface. And a ratio of a diameter of the first segmental bore to a diameter of second segmental bore is 1:1.1 to 1:2.5, a ratio of a length of the first segmental bore to a length of second segmental bore is 1:1 to 1:1.5.

In some embodiments, the two third resonant cavities are equal-diameter bores.

In some embodiments, the structured hybrid different-wavelength resonant ceramic filter further comprises a metal pattern. The input/output electrode are metal blocks formed on the ceramic substrate, and the input/output electrode are connected to one end of the resonant cavities at the first surface through the metal pattern.

In some embodiments, the structured hybrid different-wavelength resonant ceramic filter further comprises a shield cover which comprises a shield surface corresponding to the first surface to cover the first surface, wherein a distance between the shield surface and the first surface is 0.5 mm to 3 mm.

In some embodiments, the shield cover further comprises a mounting surface connected to the shield surface and disposed on a third surface of the ceramic substrate, wherein the mounting surface is provided with a limiting portion which is used to limit engagement positions of the mounting surface and the ceramic substrate.

In some embodiments, the limiting portion is a pair of protrusions provided on the mounting surface, and the pair of protrusions are hooked on the third surface.

Some advantages of the present disclosure include:

1. A structured hybrid different-wavelength resonant ceramic filter of the present disclosure is provided with two second resonant cavities and five first resonant cavities penetratingly arranged on a ceramic substrate to couple to form a fifth-order band-pass filter, and with second resonant cavities and third resonant cavities adjacent to each other penetratingly arranged on the ceramic substrate to form two band-stop filters, respectively, so as to integrate filters with various forms and functions into an integrated multi-cavities filter. The present filter is particularly suitable when the required pass bandwidth is usually 1 GHz to 1.8 GHz and high attenuation slope outside the passband is usually 100 MHz to 300 MHz away from the passband. Further, when a second or third resonance suppression ability at high frequency is required, the present filter suppress the harmonics above −20 to −50 dB, so as to realize usage at high frequency band of 5 GHz and above, with an electrical property of high suppression attenuation.

2. As to the structured hybrid different-wavelength resonant ceramic filter of the present disclosure, two second resonant cavities are located on both sides of five first resonant cavities, and two third resonant cavities are located laterally to the two second resonant cavities, respectively. The output electrode and the input electrode are disposed on the first surface and are connected to the two second resonant cavities, respectively. The present structure can be achieved only through simple structural design and metal circuit changes, and simplified circuit pattern and precise frequency control of the resonant cavities can be realized by structural design, thereby shortening debugging time of the semi-finished product.

DETAILED DESCRIPTION OF EMBODIMENTS

Figure 1:
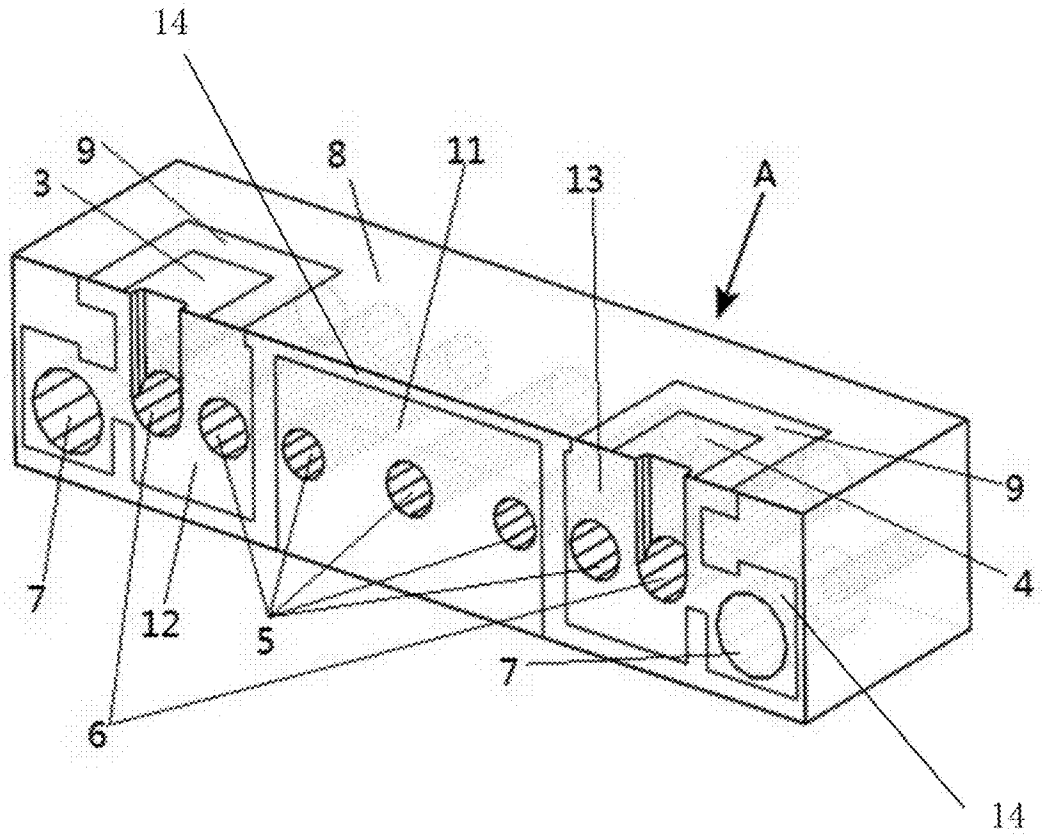
FIG. 1 is a perspective view of a structured hybrid different-wavelength resonant ceramic filter according to a first embodiment of the present disclosure.
Figure 2:
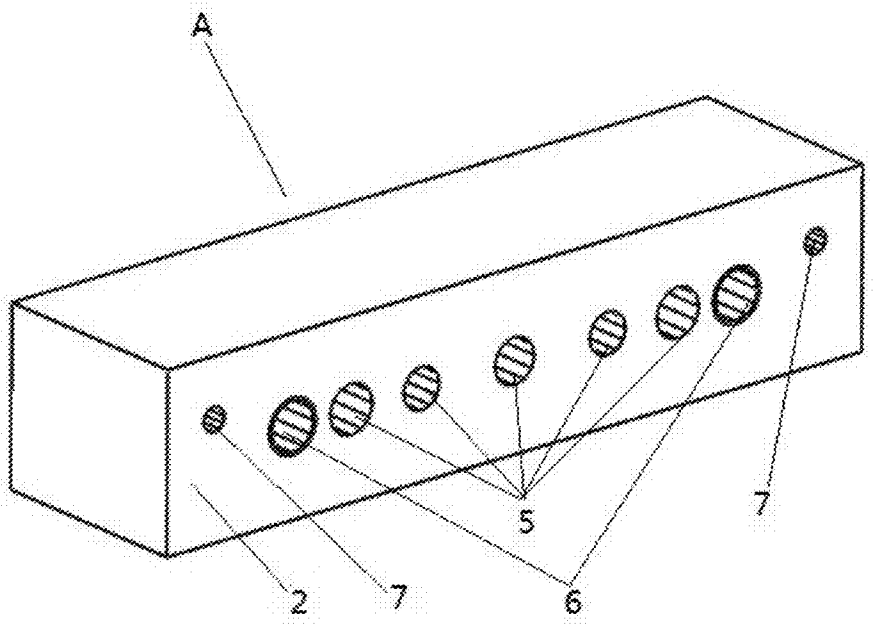
FIG. 2 is another perspective view of the structured hybrid different-wavelength resonant ceramic filter according to the first embodiment of the present disclosure.

The embodiments of the present disclosure will be clearly and completely described in conjunction with the drawings of the embodiments of the present disclosure. Apparently, what is described are some but not all of the embodiments of the present disclosure. All other embodiments obtained by a person of ordinary skill in the art based on the embodiments of the present disclosure without creative efforts are within the scope of the present disclosure. Therefore, the following detailed description of the embodiments of the present disclosure are not intended to limit the scope of the present disclosure, but to explain the selected embodiments of the present disclosure. All other embodiments obtained by a person of ordinary skill in the art based on the embodiments of the present disclosure without creative efforts are within the scope of the present disclosure.

In the description of the present disclosure, it is to be understood that the orientational or positional relationships indicated by the terms "center", "longitudinal", "transversal", "length", "width", "thickness", "upper", "lower", "front", "rear", "left", "right", "vertical", "horizontal", "top", "bottom", "inside", "outside", "clockwise", "counterclockwise", etc. are based on the orientation or positional relationship shown in the drawings, are merely for the convenience of describing the present disclosure and simplifying the description, and do not indicate or imply that the device or component referred to must have a specific orientation or be constructed and operated in a specific orientation. Therefore, it should not be construed as limiting the present disclosure.

Moreover, the terms "first" and "second" are used for descriptive purposes only and are not to be construed as indicating or implying a relative importance or implicitly indicating the number of technical features indicated. Thus, features defining "first" and "second" may include one or more of the features either explicitly or implicitly. In the description of the present disclosure, the meaning of "a plurality" is two or more unless specifically defined otherwise.

In the present disclosure, the terms "install", "connected", "connect", "fix" and the like shall be understood broadly. For example, the connection may be a fixed connection or a detachable connection or integration; may be a mechanical connection or an electrical connection; may be directly connected, may be indirectly connected through an intermediate medium, or may be an internal communication of two elements or the interaction of two elements, unless explicitly stated and defined otherwise. For those skilled in the art, the specific meanings of the above terms in the present disclosure can be understood based on specific situations.

In the present disclosure, when a first feature is described to be "on" or "under" a second feature, situations may include direct contact of the first and second features, and may also include indirect contact of first and second features through another feature therebetween, unless otherwise specifically defined and defined. Moreover, when a first feature is described to be "over", "above" and "on" the second feature, situations include that the first feature is directly not directly above the second feature, or that the first feature is merely located higher than the second feature. When a first feature is described to be "under", "below" and "down" the second feature, situations include that the first feature is directly or not directly below the second feature, or that the first feature is merely located lower than the second feature.

The present disclosure is described in further detail below with reference to the drawings and specific embodiments:

First Embodiment

Referring to FIG. 1 to FIG. 8, the electrical principle of the present disclosure is exemplified with two band-stop filters formed by the third resonant cavities 7 which are coaxial bores of a single size and different diameters. Specifically, the structured hybrid different-wavelength resonant ceramic filter according to the embodiment of the present disclosure comprises a ceramic substrate A, first input/output electrode 3 and second input/output electrode 4.

In this embodiment, the ceramic substrate A has a substantially rectangular structure, and the ceramic substrate A is made of a dielectric ceramic or other organic dielectric substance. In one embodiment, the ceramic substrate A is made of a high-dielectric ($\varepsilon\gamma$=8 to 20) microwave material and forms a ceramic filter with a length*width*height of (8.5 to 9.6) mm*(4.0 to 2.5) mm*(2.5 to 1.7) mm.

In this embodiment, the ceramic substrate A comprises a first surface 1 and a second surface 2 opposite to the first surface 1, and five first resonant cavities 5, two second resonant cavities 6 and two third resonant cavities 7 formed between the first surface 1 and the second surface 2 and penetrating in a horizontal direction. The five first resonant cavities 5 are located near the middle of the first surface 1 of the ceramic substrate A, the two second resonant cavities 6 are respectively located at both sides of the five first resonant cavities 5, and the two third resonant cavities 7 are respectively located lateral relative to the two second resonant cavities 6.

In this embodiment, in particular, five of the first resonant cavities 5 penetrate the ceramic base A at the same height, and two of the second resonant cavities 6 penetrate the ceramic base A at the same height; two of the third resonant cavities 7 penetrate the ceramic substrate A at the same height; the height of the second resonant cavities 6 is equal to the height of the first resonant cavities 5, and the height of the third resonant cavities 7 is slightly lower than (or slightly higher than) the height of the first resonant cavities 5 and the second resonant cavities 6. In this way, the overall length of the ceramic substrate A and thus the overall volume of the filter can be reduced.

In this embodiment, the resonant frequency of the filter can be adjusted by adjusting the height of the resonant cavities on the ceramic substrate A, so that the resonant frequency of the filter reaches the required frequency position to form resonance, and the specific height is determined as appropriate, which is not limited in the present disclosure.

Referring to FIG. 1, in this embodiment, the first resonant cavities 5 and the third resonant cavities 7 are half-wavelength resonant cavities, and the second resonant cavities 6 are quarter-wavelength resonant cavities. The third resonant cavities 7 are a combination of a single size coaxial bores with different diameters. Specifically, the third resonant cavities 7 comprise a first segmental bore and a second segmental bore that are coaxial, and the second segmental bore is adjacent to the first surface 1. The ratio of the diameter of the first segmental bore to that of the second segmental bore is 1:1.1 to 1:2.5, and the ratio of the length of the first segmental bore to that of the second segmental bore is 1:1 to 1:1.5. Of course, it should be noted that the diameter ratio or the length ratio of the two segmental bores can be adjusted according to actual needs, which falls within the protection scope of the present disclosure.

Figure 3:
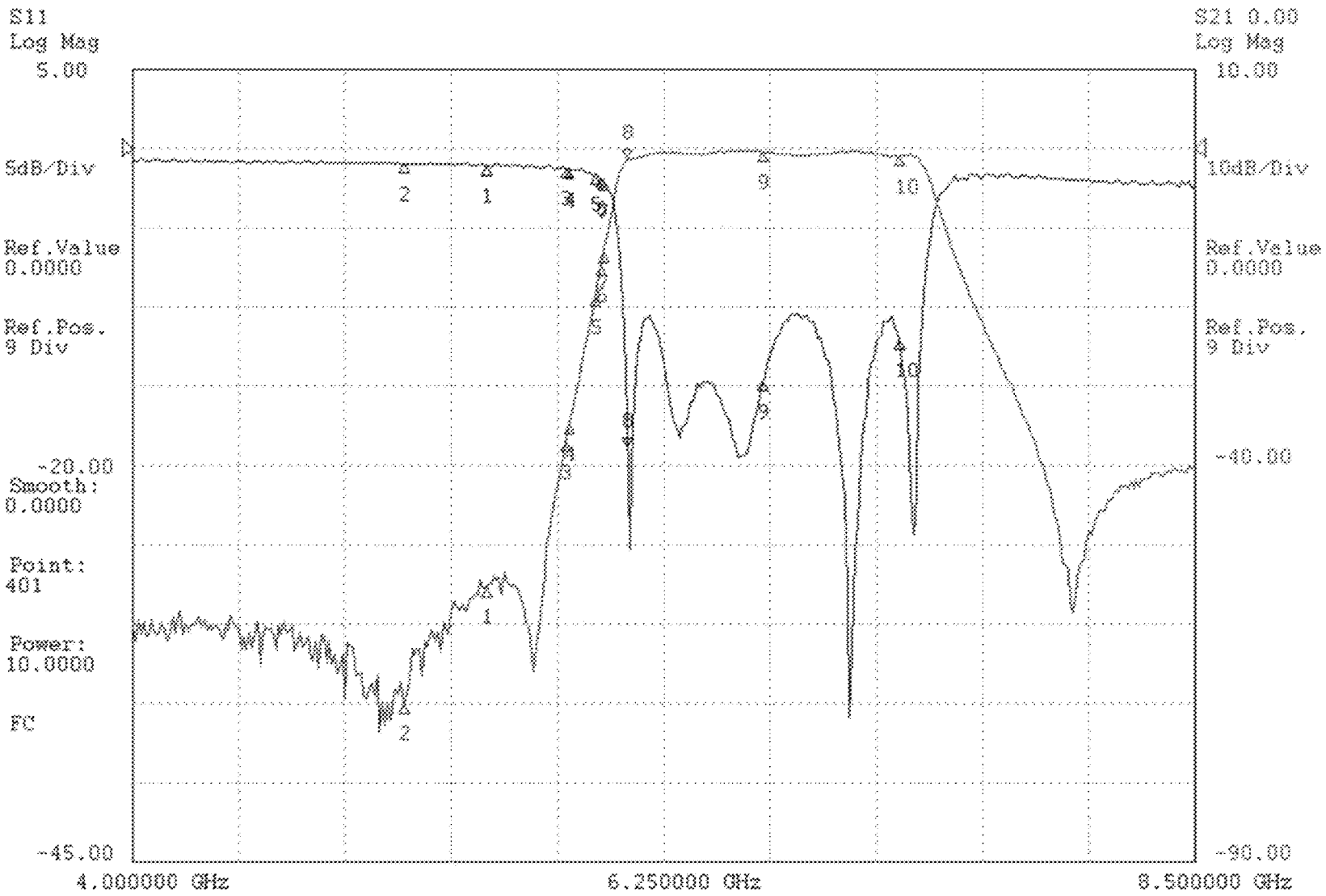
FIG. 3 is a graph showing a circuit characteristic curve of the structured hybrid different-wavelength resonant ceramic filter according to the first embodiment of the present disclosure, wherein the input and output electrodes are connected to the resonant cavities to form a quarter-wavelength resonant coupling.
Figure 4:
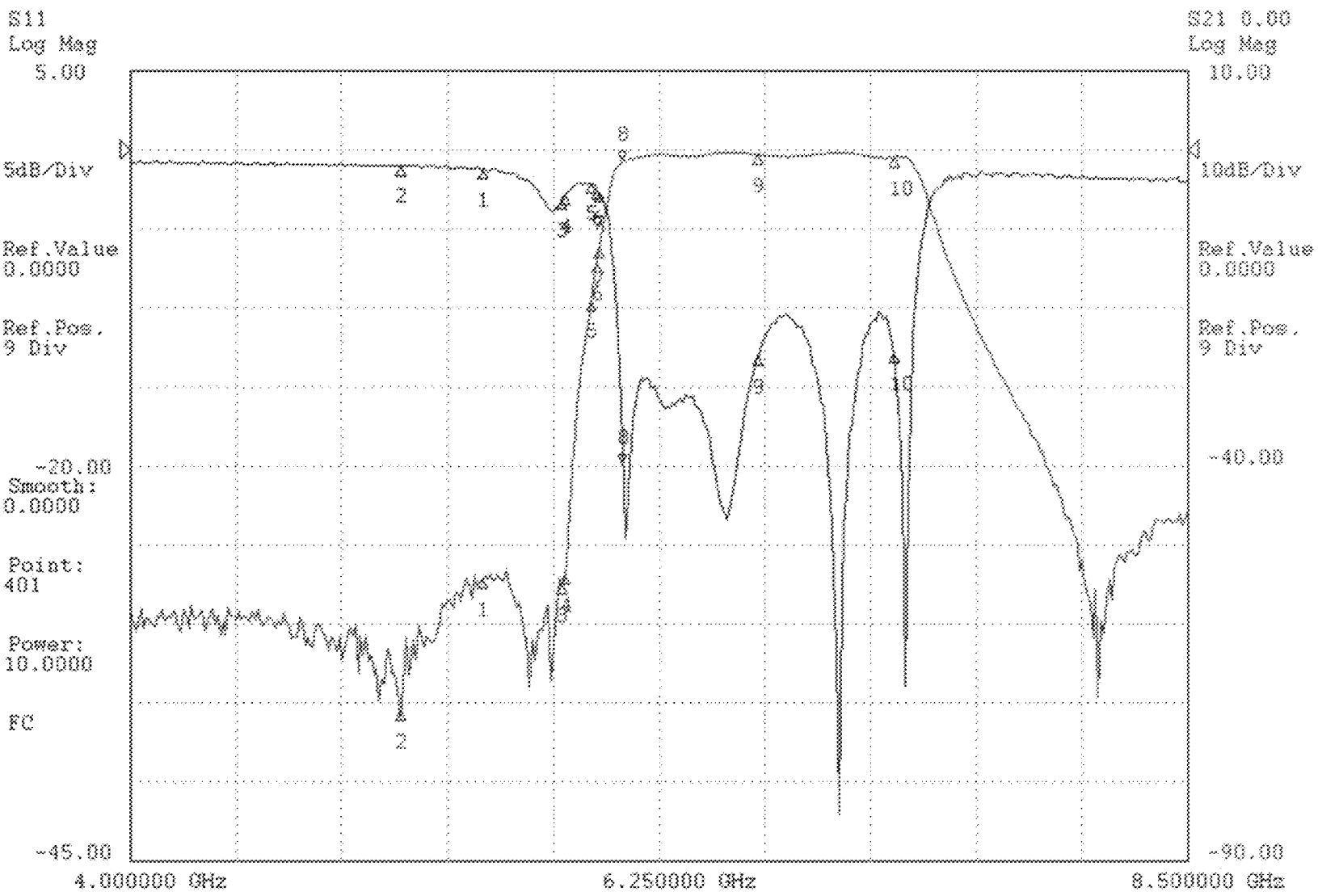
FIG. 4 is a graph showing a circuit characteristic curve of a band-pass filter of the structured hybrid different-wavelength resonant ceramic filter according to the first embodiment of the present disclosure.
Figure 5:
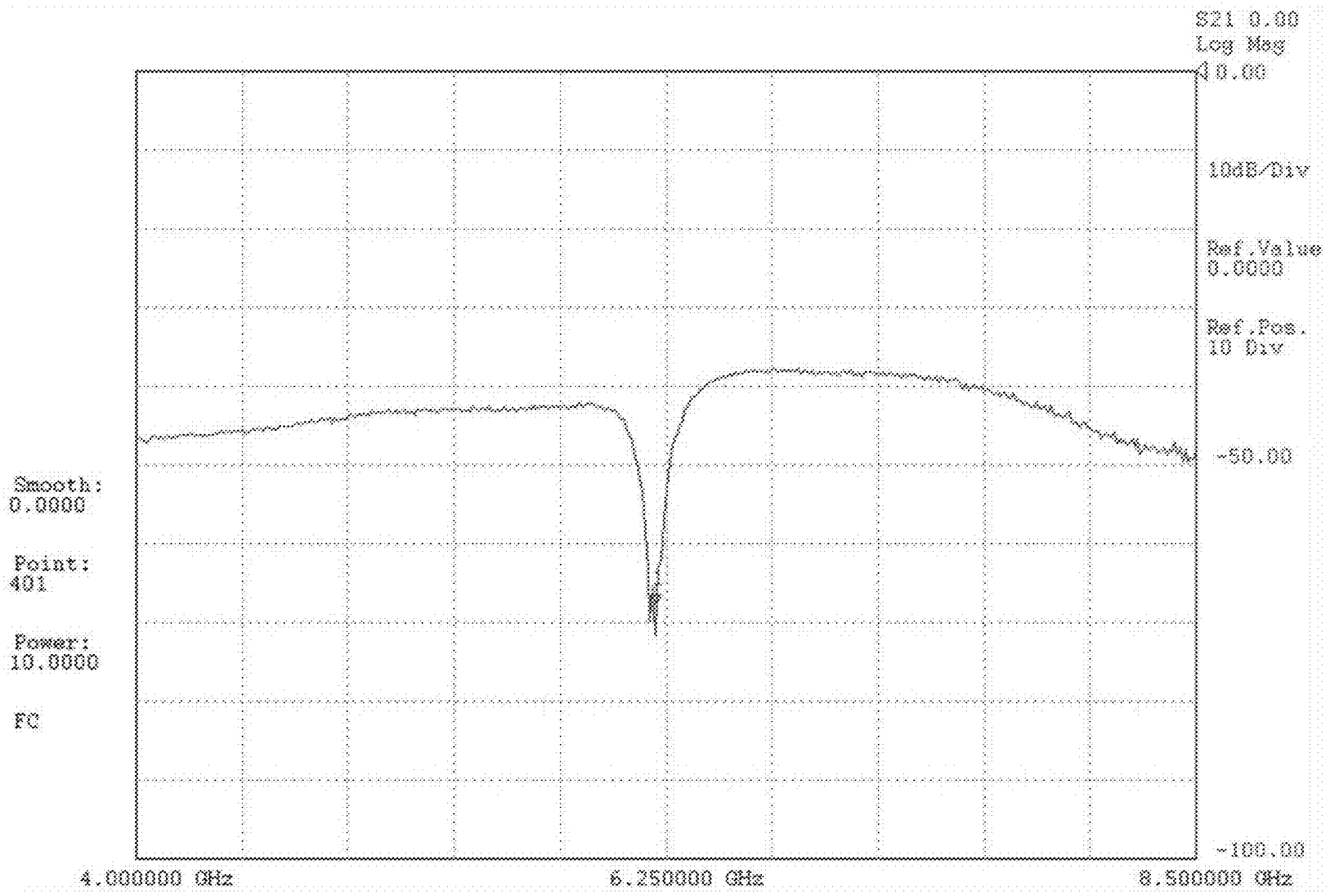
FIG. 5 is a graph showing a circuit characteristic curve of a band-stop filter of a structured hybrid different-wavelength resonant ceramic filter according to an embodiment of the present disclosure.

In this embodiment, metal is coated in each resonant cavities, and each of five of the first resonant cavities 5 and two of the third resonant cavities 7 is further coated with metal at the end on the second surface; the first input/output electrode 3 and the second input/output electrode 4 are disposed on the first surface 1 and are respectively connected to the two second resonant cavities 6. The first input/output electrode 3 and the second input/output electrode 4 are connected to two of the third resonant cavities 7 and five of the first resonant cavities 5 through a metal pattern 14. Specifically, the two input and output electrodes are directly connected to one end of the resonant cavities which are coated with metal by the metal pattern 14, and the other end is opened to form a quarter-wavelength resonant coupling, the electrical property of which is shown in FIG. 3. Among them, five of the first resonant cavities 5 are coupled to form a fifth-order band-pass filter. Specifically, an inner surface and one end of each of the half-wavelength five first resonant cavities 5 are coated with metal; the metal pattern 14 is directly attached at the metal-free open end to form a half-wavelength five-bore band-pass filter, the electrical property of which is shown in FIG. 4. Each of the second resonant cavities 6 is coupled to an adjacent one of the third resonant cavities 7 to form a band-stop filter with the inner surface and one end coated with metal, and an open ½ wave wavelength resonant cavities is formed at one end, the electrical property of which is shown in FIG. 5. It can be understood that the resonance mode may be inductive coupling or capacitive coupling, which is not limited in the present disclosure.

In this embodiment, the first surface 1 is further provided with a first hollowed-out area in which a metal coating is not applied and the body of the ceramic substrate A is exposed. The first hollowed-out area comprises a first sub-region 11, a second sub-region 12 and a third sub-region 13 that are spaced-apart, wherein the second sub-region 12 surrounds three of the first resonant cavities 5 in the middle at the same time, and the first sub-region 11 and the third sub-region 13 surrounds the second resonant cavities 6 and the third resonant cavities 7 at both sides of the second sub-region 11 respectively. Of course, it can be understood that the first hollowed-out area may also be provided around each of the first resonant cavities 4, which is not limited in the present disclosure.

In this embodiment, the ceramic substrate A further comprises a top surface 8 connected between the first surface 1 and the second surface 2. The top surface 8 is provided with two second hollowed-out areas 9 which are arranged with a certain separation therebetween and are not in contact with each other. Each second hollowed-out area 9 extends to the first surface 1 and is connected to the first hollowed-out area as a whole.

The first input/output electrode 3 and the second input/output electrode 4 are respectively disposed in the two first hollowed-out areas 9 and partially extend to the first surface 1. The first input/output electrode 3 and the second input/output electrode 4 may be covered on the ceramic substrate A by screen printing, or a silver electrode may be connected to the ceramic substrate A by high-temperature metallizing silver electrode, or an outer surface of the ceramic substrate A can be covered with a conductive metal layer for molding by using laser etching or the like.

In summary, in the structured hybrid different-wavelength resonant ceramic filter provided in this embodiment, five first resonant cavities 5, two second resonant cavities 6 and two third resonant cavities 7 penetrating in a horizontal direction are formed between the first surface 1 and the second surface 2, to form a fifth-order band-pass filter and two band-stop filters, thereby realizing a multi-cavities filter integrated with various filter forms and functions. The present filter is particularly suitable when the required pass bandwidth is usually 1 GHz to 1.8 GHz and high attenuation slope outside the passband is usually 100 MHz to 300 MHz away from the passband. Further, when a second or third resonance suppression ability at high frequency is required, the present filter suppress the harmonics above −20 to −50 dB, so as to realize usage at high frequency band of 5 GHz and above, with an electrical property of high suppression attenuation.

To facilitate the understanding of the present disclosure, some embodiments of the present disclosure are further described below.

Figure 6:
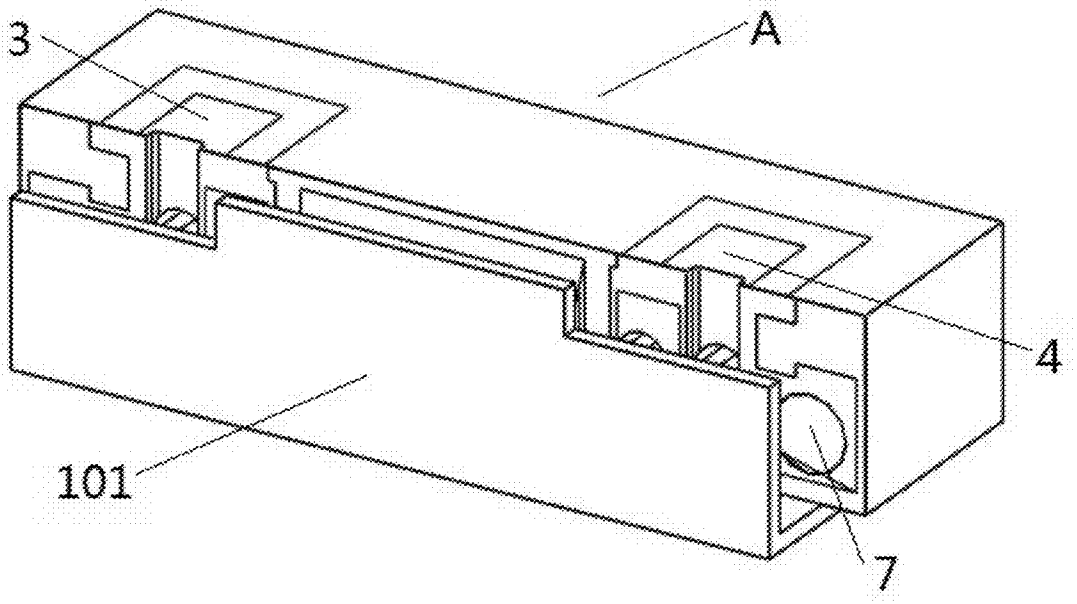
FIG. 6 is a perspective view of the structured hybrid different-wavelength resonant ceramic filter according to the first embodiment of the present disclosure with an externally welded shield cover.
Figure 7:
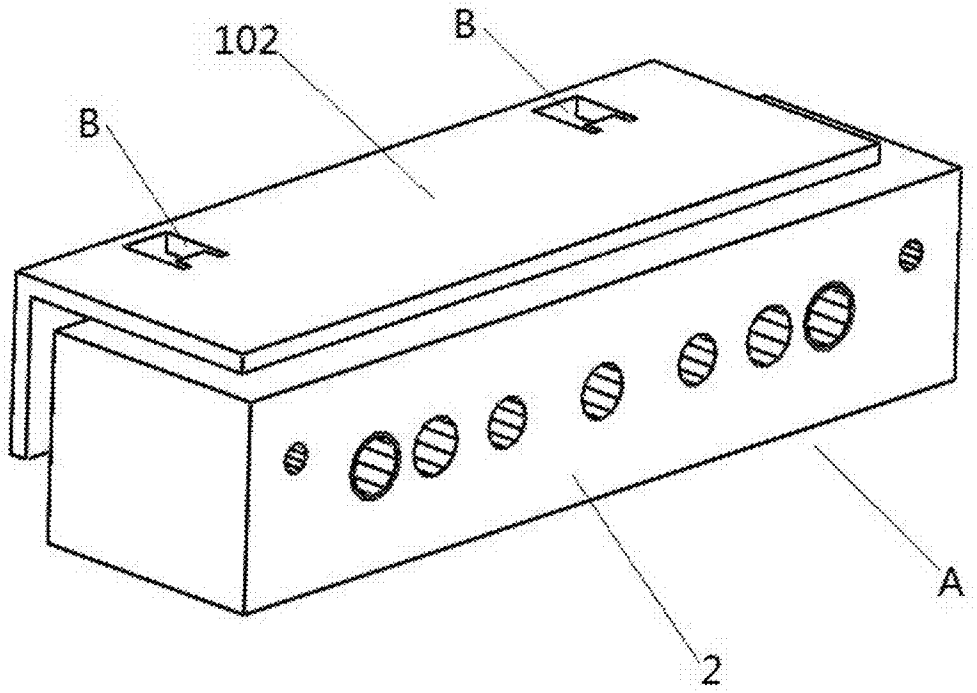
FIG. 7 is another perspective view of the structured hybrid different-wavelength resonant ceramic filter according to the first embodiment of the present disclosure with an externally welded shield cover.
Figure 8:
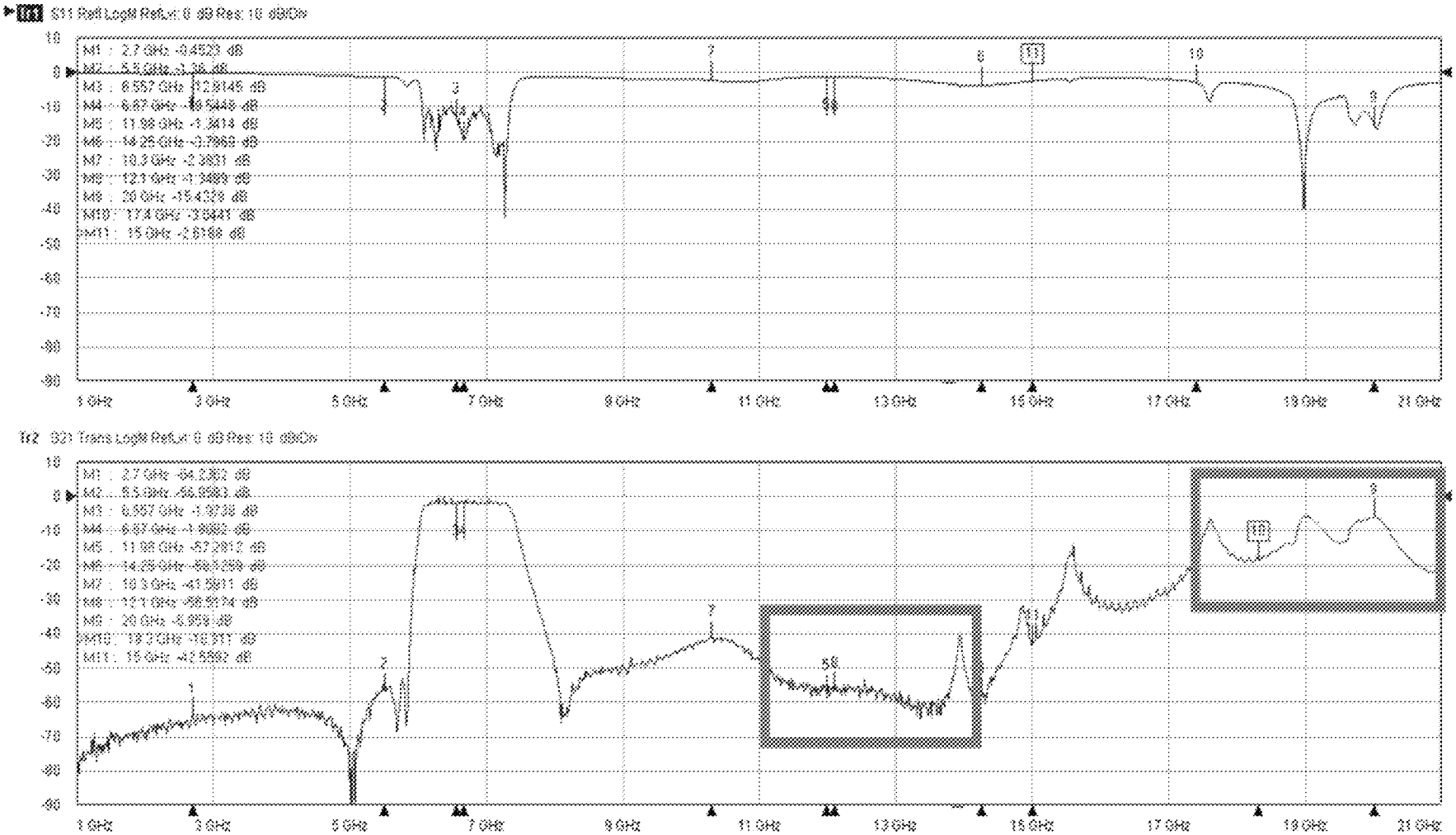
FIG. 8 is a graph showing suppressing the resonance effects of the double frequency and the triple frequency of the structured hybrid different-wavelength resonant ceramic filter according to the first embodiment of the present disclosure with an externally welded shield cover.

Referring to FIG. 6 to FIG. 8, based on the above embodiments, in other embodiments of the present disclosure, a shield cover 10 is further provided. The shield cover 10 has a shield surface 101 supported on the first surface 1 vertically and horizontally. A distance between the shield surface 101 and the first surface 1 is 0.5 mm to 3 mm. The shield cover 10 has a mounting surface 102 connected to the shield surface 101 and disposed on the ceramic base A. The mounting surface 102 is provided with a limiting portion B for limiting the engagement position of the mounting surface 102 and the ceramic base A. The limiting portion B is a pair of protrusions provided on the mounting surface 102, and the pair of protrusions are hooked on a third surface (e.g., the bottom surface), so that the metal shield cover and the filter are welded together and can be regarded as a whole, as shown in FIGS. 6 and 7. After the shield cover is externally welded to the present filter, the electromagnetic coupling interference of resonant cavity parts can be reduced, and the double-frequency and triple-frequency resonance effects can be suppressed. The resonance effect is shown in FIG. 8.

Second Embodiment

Figure 9:
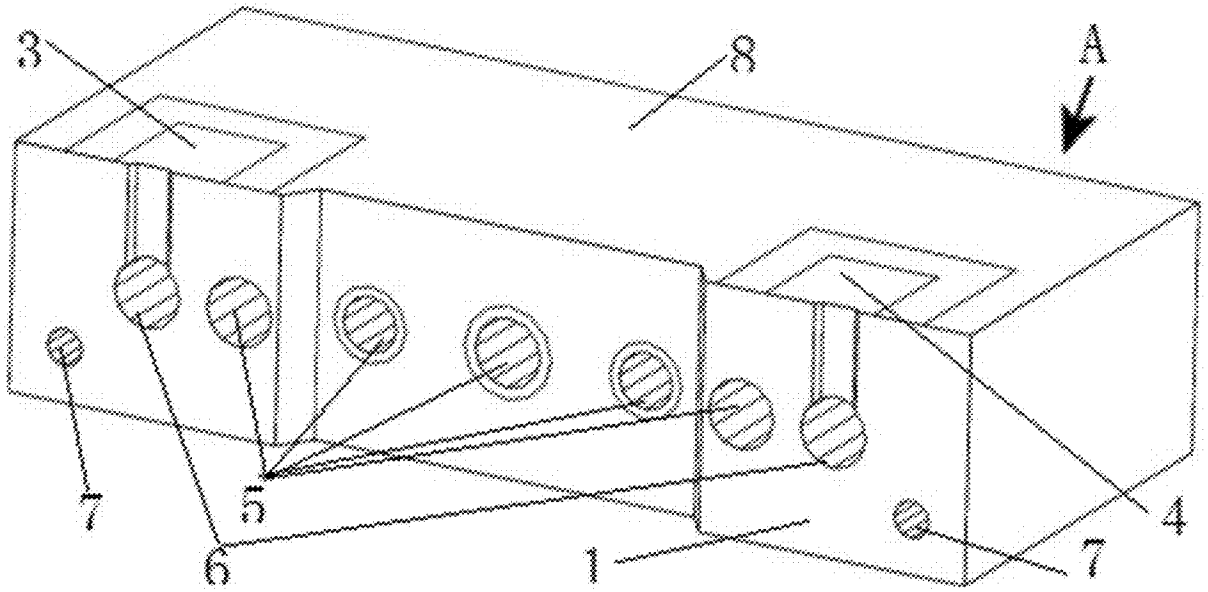
FIG. 9 is a perspective view of the structured hybrid different-wavelength resonant ceramic filter according to a second embodiment of the present disclosure.
Figure 10:
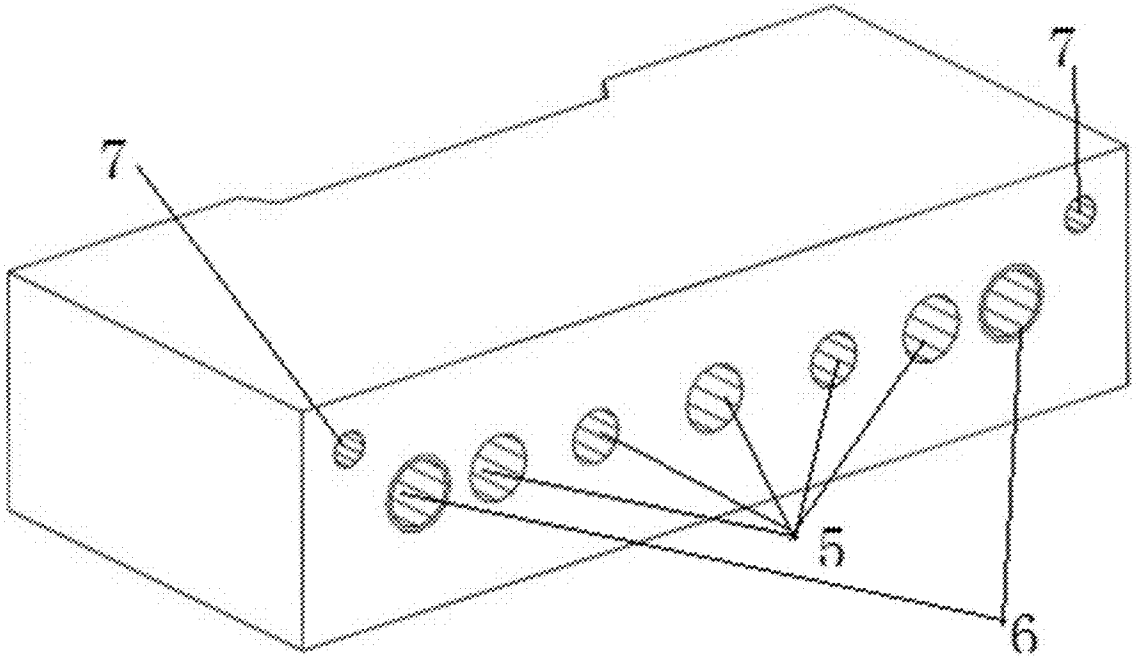
FIG. 10 is another perspective view of the structured hybrid different-wavelength resonant ceramic filter according to the second embodiment of the present disclosure.

Referring to FIGS. 9 and 10, the electrical principle of the present disclosure is exemplified with two band-stop filters formed by the third resonant cavities 7 which are coaxial bores of a single diameter. Specifically, two of the third resonant cavities 7 are equal-diameter bores. Of course, it should be noted that the diameter ratio or length ratio of the bores can be adjusted according to actual needs, which falls within the protection scope of the present disclosure.

Figure 11:
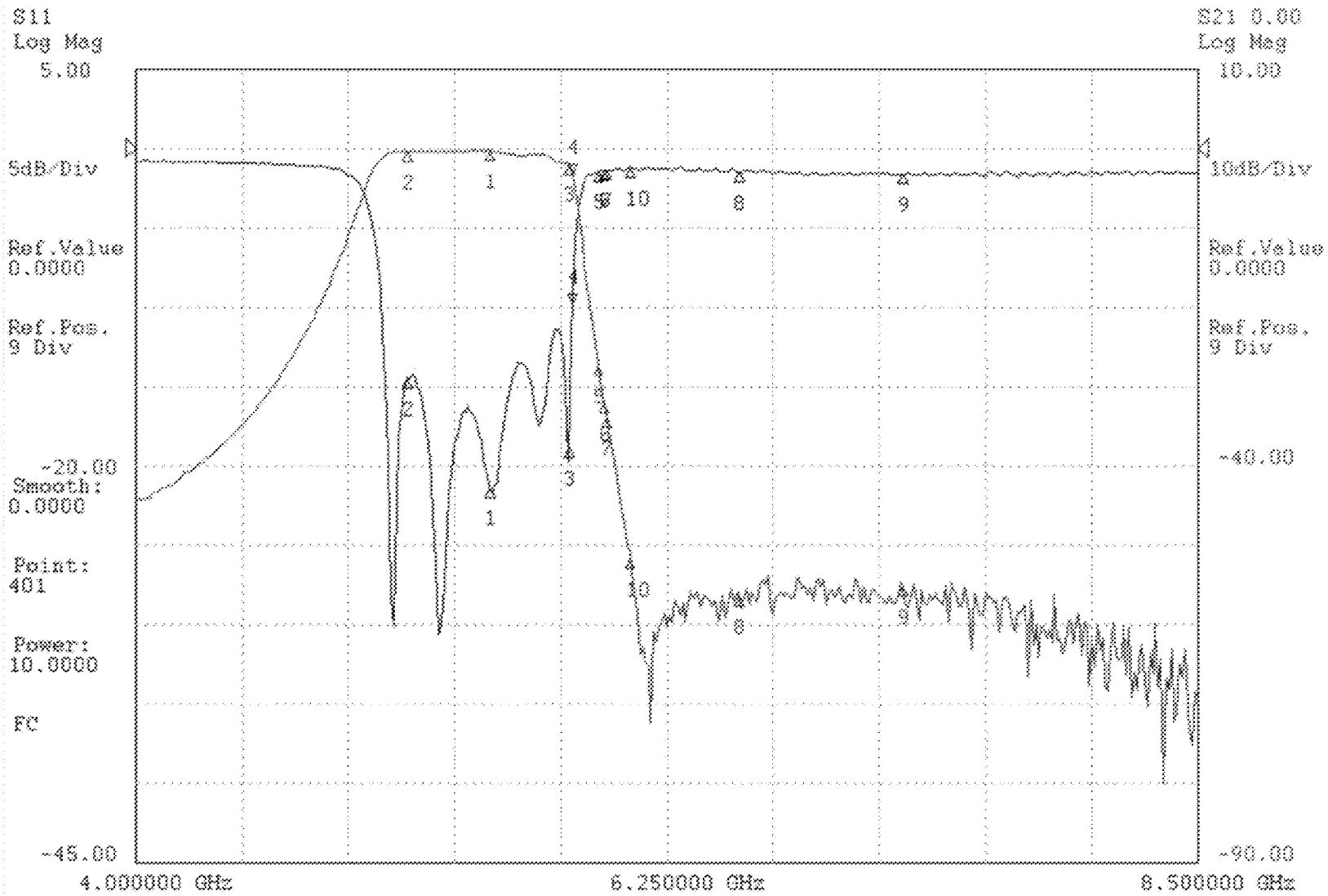
FIG. 11 is a graph showing a circuit characteristic curve of the structured hybrid different-wavelength resonant ceramic filter according to the second embodiment of the present disclosure, wherein the input and output electrodes are connected to the resonant cavities to form a quarter-wavelength resonant coupling.
Figure 12:
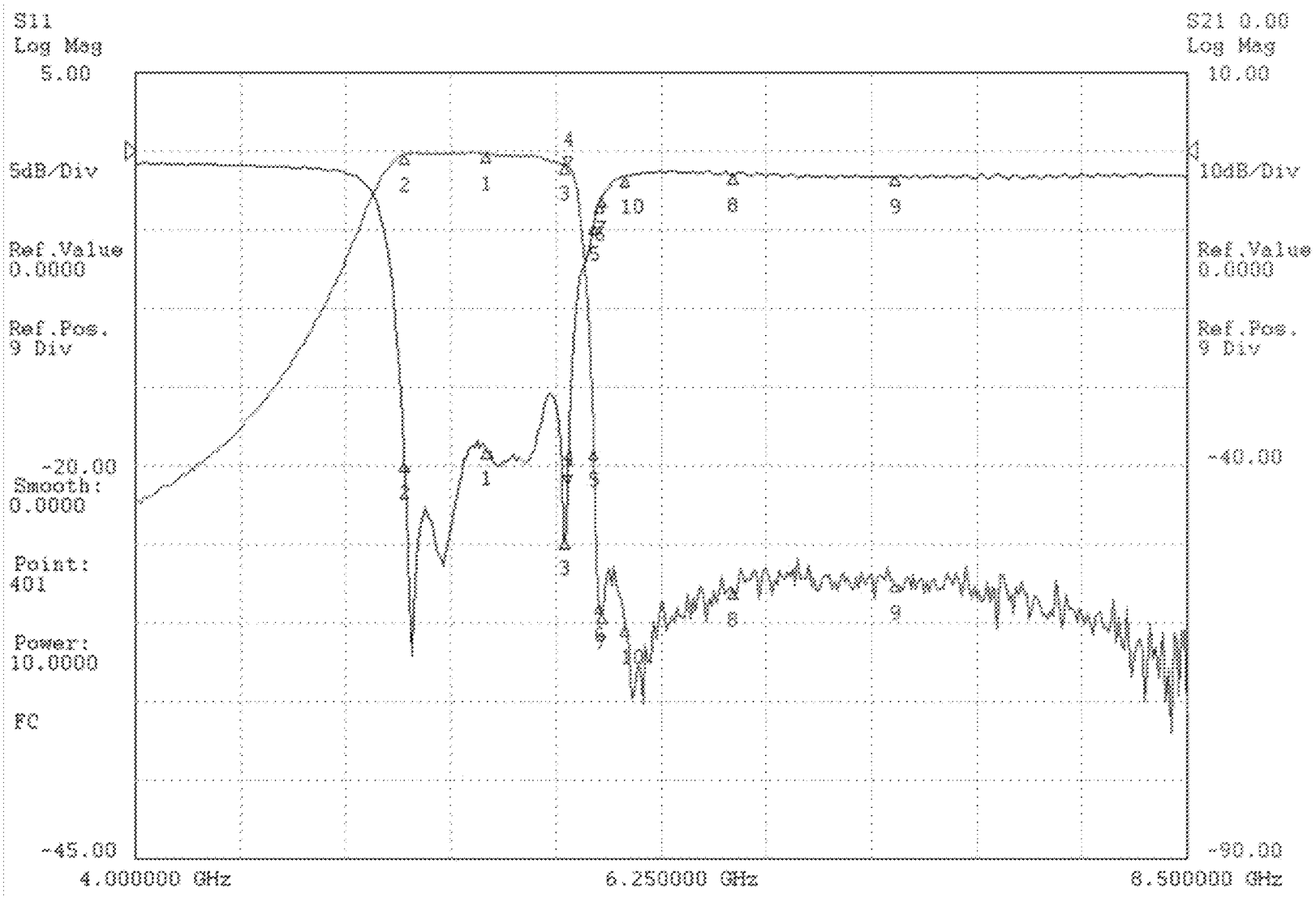
FIG. 12 is a graph showing a circuit characteristic curve of a band-pass filter of the structured hybrid different-wavelength resonant ceramic filter according to the second embodiment of the present disclosure.

Specifically, the two input and output electrodes are directly connected to one end of the resonant cavities which are coated with metal by the metal pattern 14, and the other end is opened to form a quarter-wavelength resonant coupling, the electrical property of which is shown in FIG. 11. Five of the first resonant cavities 5 are coupled to form a fifth-order band-pass filter. Specifically, an inner surface and one end of each of the half-wavelength five first resonant cavities 5 are coated with metal; the metal pattern 14 is directly attached at the metal-free open end to form a half-wavelength five-bore band-pass filter, the electrical property of which is shown in FIG. 12. Each of the second resonant cavities 6 is coupled to an adjacent one of the third resonant cavities 7 to form a band-stop filter with the inner surface and one end coated with metal, and an open ½ wave wavelength resonant cavities is formed at one end, the electrical property of which is shown in FIG. 5. It can be understood that the resonance mode may be inductive coupling or capacitive coupling, which is not limited in the present disclosure.

The above is only some embodiments of the present disclosure and is not intended to limit the present disclosure. To those of ordinary skill in the art, various modifications and changes can be made to the present disclosure. Any modifications, equivalent substitutions, improvements, etc. made within the spirit and scope of the present disclosure are intended to be included within the scope of the present disclosure.

What is claimed is:

1. A structured hybrid different-wavelength resonant ceramic filter, comprising a ceramic substrate and an input/output electrode, wherein the ceramic substrate comprises a first surface and a second surface opposite to the first surface, five first resonant cavities, two second resonant cavities and two third resonant cavities which penetrate the ceramic substrate are formed between the first surface and the second surface;

the five first resonant cavities are located in a middle of the first surface of the ceramic substrate, the two second resonant cavities are respectively located at both sides of the five first resonant cavities, and the two third resonant cavities are respectively located lateral relative to the two second resonant cavities;

an inner wall of each of the resonant cavities is coated with metal, and five of the first resonant cavities and two of the third resonant cavities are coated with metal at one end located on the second surface; the input/output electrode are disposed at the first surface, and are electrically connected to two of the second resonant cavities; five of the first resonant cavities are coupled to form a fifth-order band-pass filter, and each of the second resonant cavities is coupled to an adjacent one of the third resonant cavities to form a band-stop filter;

wherein the first resonant cavities and the third resonant cavities are half-wavelength resonant cavities, and the second resonant cavities are quarter-wavelength resonant cavities.

2. The structured hybrid different-wavelength resonant ceramic filter according to 1, wherein:

five of the first resonant cavities and two of the second resonant cavities are arranged at a same height on the ceramic substrate and are located approximately at a center of the first surface of the ceramic substrate; two of the third resonant cavities are arranged at a same height on the ceramic substrate, and a height of the third resonant cavities is slightly lower a the height of the first resonant cavities and the second resonant cavities.

3. The structured hybrid different-wavelength resonant ceramic filter according to claim 1, wherein the ceramic substrate has a rectangular structure.

4. The structured hybrid different-wavelength resonant ceramic filter according to claim 1, wherein the third resonant cavities comprise a first segmental bore and a second segmental bore that are coaxial to each other, the second segmental bore is adjacent to the first surface, and a ratio of a diameter of the first segmental bore to a diameter of second segmental bore is 1:1.1 to 1:2.5, a ratio of a length of the first segmental bore to a length of second segmental bore is 1:1 to 1:1.5.

5. The structured hybrid different-wavelength resonant ceramic filter according to claim 2, wherein the two third resonant cavities are equal-diameter bores.

6. The structured hybrid different-wavelength resonant ceramic filter according to claim 1, further comprising a metal pattern, the input/output electrode are metal blocks formed on the ceramic substrate, and the input/output electrode are connected to one end of the resonant cavities at the first surface through the metal pattern.

7. The structured hybrid different-wavelength resonant ceramic filter according to claim 3, further comprising a shield cover which comprises a shield surface corresponding to the first surface to cover the first surface, wherein a distance between the shield surface and the first surface is 0.5 mm to 3 mm.

8. The structured hybrid different-wavelength resonant ceramic filter according to 7, wherein the shield cover further comprises a mounting surface connected to the shield surface and disposed on a third surface of the ceramic substrate, wherein the mounting surface is provided with a limiting portion which is used to limit engagement positions of the mounting surface and the ceramic substrate.

9. The structured hybrid different-wavelength resonant ceramic filter according to claim 7, wherein the limiting portion is a pair of protrusions provided on the mounting surface, and the pair of protrusions are hooked on the third surface.

* * * * *